US007256548B2

(12) United States Patent
Janczak et al.

(10) Patent No.: US 7,256,548 B2
(45) Date of Patent: Aug. 14, 2007

(54) ELECTRIC CIRCUIT FOR IGNITING A DISCHARGE LAMP, AND ELECTRIC COMPONENT MODULE AND DISCHARGE LAMP INCORPORATING SUCH AN ELECTRIC CIRCUIT

(75) Inventors: Jerzy Janczak, Eindhoven (NL); Johannes Maria Van Meurs, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 0 days.

(21) Appl. No.: 10/507,189

(22) PCT Filed: Feb. 12, 2003

(86) PCT No.: PCT/IB03/00539

§ 371 (c)(1),
(2), (4) Date: Sep. 9, 2004

(87) PCT Pub. No.: WO03/077613

PCT Pub. Date: Sep. 18, 2003

(65) Prior Publication Data

US 2005/0104538 A1 May 19, 2005

(30) Foreign Application Priority Data

Mar. 13, 2002 (EP) ..... 02075985

(51) Int. Cl.
*H01J 7/44* (2006.01)

(52) U.S. Cl. ..... 315/57; 315/70

(58) Field of Classification Search ..... 315/56–59, 315/62, 70–71, 326, 358, 51, 52, 53, 54
See application file for complete search history.

(56) References Cited

U.S. PATENT DOCUMENTS

| | | | | |
|---|---|---|---|---|
| 4,134,042 | A * | 1/1979 | van Heemskerck Veeckens | 315/59 |
| 4,328,446 | A * | 5/1982 | Fallier et al. | 315/47 |
| 4,342,948 | A * | 8/1982 | Samuels | 315/290 |
| 4,355,261 | A * | 10/1982 | Cohen et al. | 315/47 |
| 4,414,489 | A * | 11/1983 | Young | 315/51 |
| 4,714,862 | A * | 12/1987 | Dannert et al. | 315/244 |
| 5,248,913 | A * | 9/1993 | Heider | 313/25 |
| 5,336,974 | A * | 8/1994 | Luijks et al. | 315/58 |
| 5,606,222 | A * | 2/1997 | Cottaar et al. | 315/58 |
| 5,945,786 | A * | 8/1999 | Jurek | 315/276 |
| 6,100,643 | A * | 8/2000 | Nilssen | 315/209 R |
| 6,191,538 | B1 * | 2/2001 | Hirschmann et al. | 315/240 |
| 6,320,328 | B1 | 11/2001 | Kenyon et al. | 315/291 |
| 6,323,604 | B1 * | 11/2001 | Boenigk et al. | 315/290 |

FOREIGN PATENT DOCUMENTS

| | | |
|---|---|---|
| FR | 2466169 | 3/1981 |
| FR | 2502443 | 2/1982 |
| WO | WO199304478 | 3/1993 |

* cited by examiner

*Primary Examiner*—Thuy Vinh Tran

(57) ABSTRACT

An electric circuit for igniting a discharge lamp includes a voltage source, and at least one condenser electrically connected to the voltage source. Further, a series chain is provided, electrically connected in parallel with the condenser, of at least one ignition and at least one inductor. A discharge lamp is electrically connected in parallel with the ignition.

8 Claims, 2 Drawing Sheets

Figure 1:
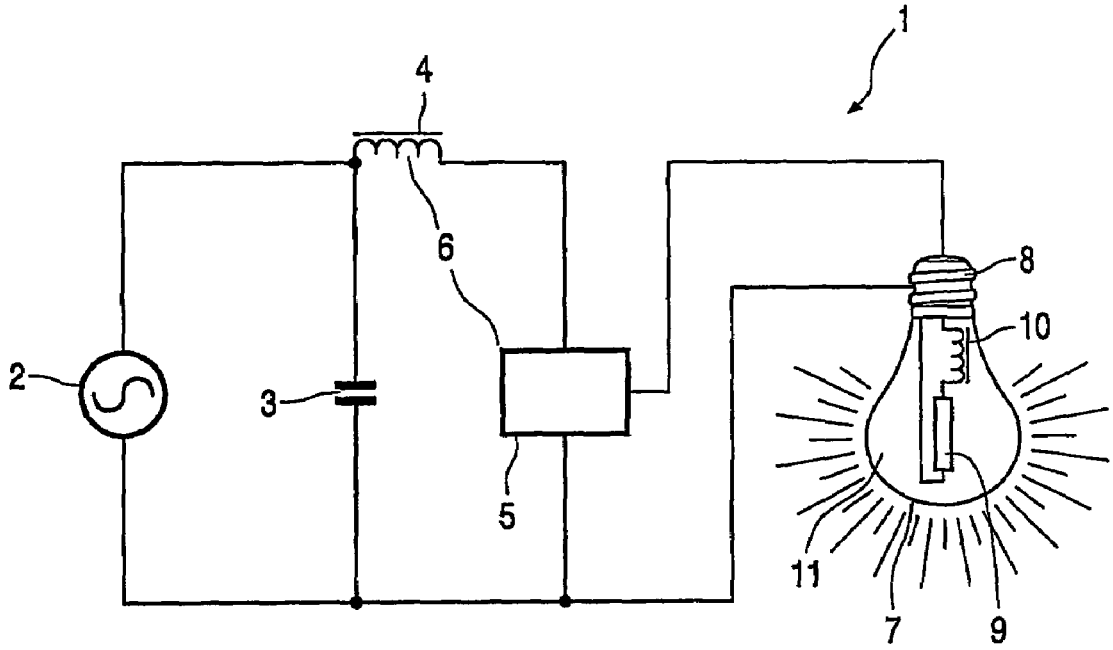

ELECTRIC CIRCUIT FOR IGNITING A DISCHARGE LAMP, AND ELECTRIC COMPONENT MODULE AND DISCHARGE LAMP INCORPORATING SUCH AN ELECTRIC CIRCUIT

The invention relates to an electric circuit for igniting a discharge lamp, comprising a voltage source, at least one first condenser electrically connected to the voltage source, a series chain, electrically connected in parallel with the first condenser, of at least one ignition and at least one first inductor, and a discharge lamp electrically connected in parallel with the ignition, which discharge lamp is provided with a discharge vessel. The invention also relates to an electric component module for use in such an electric circuit. The invention further relates to a discharge lamp incorporating such an electric circuit.

The awareness of the need for power conservation is becoming a significant factor both for purchasers as well as for lighting equipment manufacturers. The feature of a higher efficacy of a burner of High Pressure Sodium (HPS) lamps while retaining at least the same light intensity results in a lower power consumption, which creates clear benefits for the purchaser. A method known in the art to achieve a lower power consumption consists in lowering the burner operating voltage, thus shifting the operation point of the lamp to lower power. However, applying said method is accompanied by several drawbacks. One of the drawbacks is that the implementation of a lower burner voltage causes overstressing of a ballast, which is electrically connected with the lamp, as a result of an increase of the input current to the electric circuit. An increase of the current results generally in a shortening of the lifetime of one or more electric components, such as the ballast and the lamp that are part of the operating electric circuit.

The invention has for its object to provide an electric circuit with which at least a conventional light output of the discharge lamp can be generated at a relatively low power consumption without overstressing components forming part of the electric circuit.

The invention provides for this purpose an electric circuit of the type stated in the preamble, characterized in that the electric circuit is provided with a second inductor which is electrically connected in series with the discharge vessel. By on the one hand applying a relatively low operating voltage across the electric circuit, and on the other hand limiting the current—which increases as a result of the low operating voltage—by applying the second inductor, a light intensity of the light radiation generated by the discharge lamp which is substantially constant compared to the prior art can be obtained at a relatively low energy consumption. A higher light efficiency of the discharge lamp will thus be obtained. One inference is that the lower energy consumption will result in less stress on the components incorporated in the electric circuit, which will increase the lifespan of the components. The second inductor is particularly suitable for application in electric circuits in which the resistance value of the first inductor (the ballast) is too low to substantially fully compensate the increase in current resulting from the lower operating voltage. Owing to the substantially full compensation effect, causing an increase of the current in the electric circuit due to the decrease of the operating voltage to be compensated by a (substantially equally large) lowering of the current by the second inductor, the current will be substantially equal to the current in a prior art electric circuit. It will be apparent that the second inductor can also be replaced by another type of electric component with a substantially comparable functionality, i.e. of reducing the current in the electric circuit. Examples of such other components are a heat-sensitive resistor, such as a PTC-resistor, and a light-sensitive resistor.

The discharge lamp is preferably formed by a high-pressure discharge lamp, which in particular is provided with sodium. However, in addition to applying a discharge vessel in which a relatively high pressure prevails, it is also possible to apply a discharge vessel in which a relatively low pressure is present, such as for instance a low-pressure discharge lamp, which in particular is provided with sodium. Such a lamp is also referred to as LPS lamp. In addition to sodium lamps it is also possible to apply High-Pressure Mercury Vapour Lamps in an electric circuit according to the invention.

In a preferred embodiment the second inductor has an impedance of between 2 Ω and 10 Ω, preferably 4 Ω, when a discharge lamp of 250 Watts is applied. The optimal value of the second inductor depends among other things on the nature and technical properties of the components incorporated in the electric circuit, including the power to be processed by the lamp.

In another preferred embodiment the discharge lamp is provided with a second condenser, which second condenser is connected in parallel with the second inductor and is connected in series with the discharge vessel. Test results show that the inclusion of a second condenser in the discharge lamp stimulates the ignition of the discharge vessel. In addition, the second condenser has a stabilizing effect on the electrical circuit in the operative mode, whereby optimal functioning of the electric circuit can be achieved. The capacitance of the second condenser preferably lies between 5 nF and 15 nF, and is preferably 10 nF. As already stated in the foregoing, the optimal value of the capacitance of the second condenser depends among other things on the nature and properties of other components incorporated in the electric circuit.

The invention also provides an electric component module for use in such an electric circuit, in particular as an add-on device to the lamp. The electric component module is preferably provided with a plug for releasable coupling of the component module to the first condenser, a socket for releasable coupling of the component module to the discharge lamp, and at least one electric component electrically connected to the plug and the socket. After coupling of the component module to the condenser and the discharge lamp, the electric component arranged in the component module is consequently incorporated in the electric circuit. Application of the component module in the electric circuit gives the circuit a certain adaptive capability. A suitable component module can be built into the electric circuit subject to the requirements set for the electric circuit. Owing to the releasable coupling between the component module and other electric components it is possible to replace the component module in a simple and not very time-consuming manner in the case of a malfunction one or more of the (electric) components forming part of the component module. The presence of a component module therefore increases the accessibility of the electrical components arranged in the component module. Another advantage is that existing fittings with built-in choke can be modified in a relatively simple manner such that they meet the requirements of an electric circuit for igniting a discharge lamp according to the present invention. The electric component serves particularly to reduce the current running through the electric circuit.

In a preferred embodiment the electric component is formed by the second inductor. As already stated above, another type of electric component with a substantially comparable functionality, i.e. of reducing the current, can also be applied instead of the second inductor. An example of such another type of component is for instance a thermoresistor, preferably a PTC-resistor, or a light-sensitive resistor. In a particular, preferred embodiment the electric component is formed by the second inductor and a second condenser electrically connected in parallel with the second inductor.

The invention further provides a discharge lamp for use in an electric circuit as described above. The discharge lamp is preferably provided with the second inductor which is electrically connected in series with the discharge vessel. Since the inductor reduces the current, incorporation of the discharge lamp in the electric circuit will—at a relatively low operating voltage—generally result in a relatively low energy consumption at an at least practically constant light output. A lower current in the electric circuit will generally result in a lower stress on the components incorporated in the electric circuit, which enhances the lifespan of the components.

Figure 2:
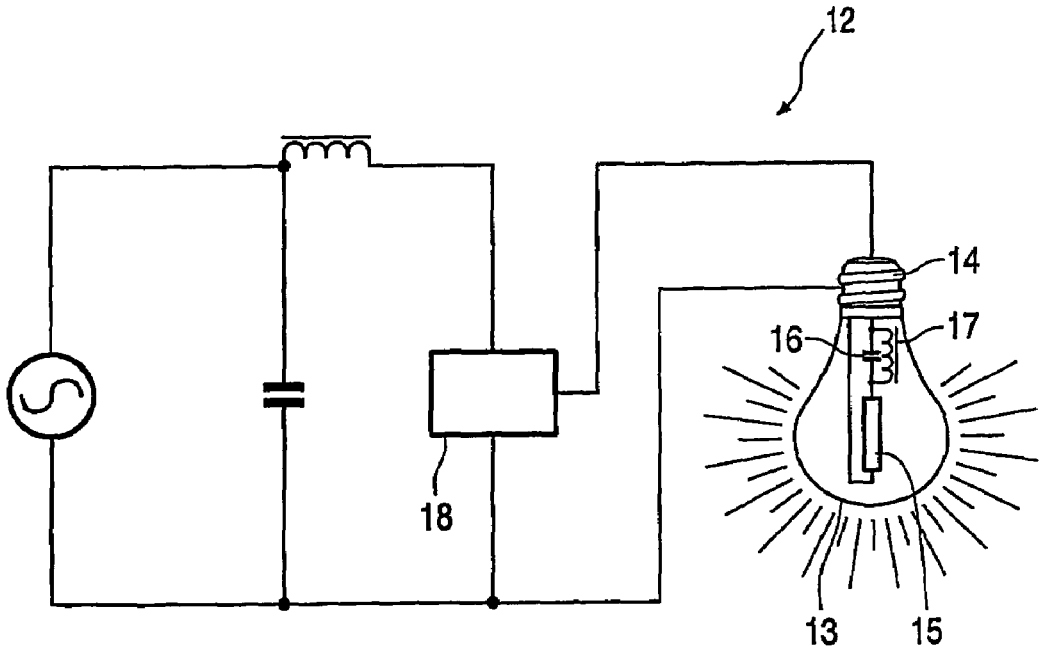
Figure 3:
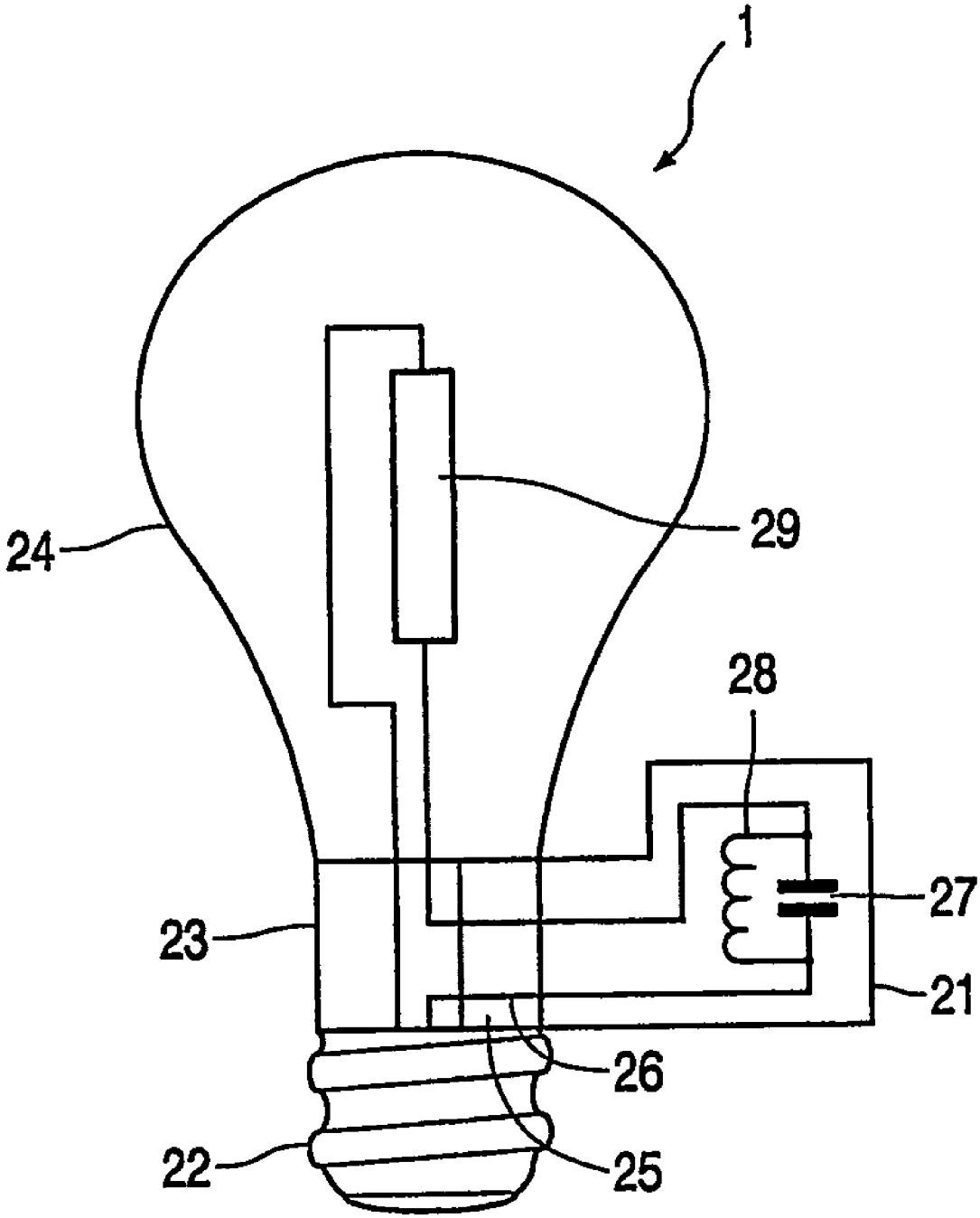

The invention will be elucidated on the basis of non-limitative embodiments shown in the following Figures. Herein:

FIG. 1 shows an electric circuit diagram corresponding with a first preferred embodiment of the invention, FIG. 2 shows an electric circuit diagram corresponding with a second preferred embodiment of the invention, and FIG. 3 shows a discharge lamp provided with an electric component module according to the invention.

FIG. 1 shows an electric circuit diagram 1 corresponding with a first preferred embodiment of the invention. Diagram 1 comprises an alternating voltage source 2, a condenser 3 electrically connected to the alternating voltage source 2, a first inductor 4 and an igniter 5. First inductor 4 and igniter 5 form a series chain 6, which series chain 6 is electrically connected in parallel with the alternating voltage source 2 relative to condenser 3. Diagram 1 is also provided with a discharge lamp 7 which is included in the diagram in parallel connection with igniter 5. Discharge lamp 7 is provided with a lamp cap 8, a discharge vessel 9 electrically connected to lamp cap 8, and a second inductor 10 electrically connected in series with discharge vessel 9. For protection purposes the discharge vessel 9 and second inductor 10 are mounted in an outer bulb 11 connected to lamp cap 8. Advantages of the present preferred embodiment have already been described above.

FIG. 2 shows an electric circuit diagram 12 corresponding to a second preferred embodiment of the invention. Diagram 12 is practically identical to the electric circuit diagram shown in FIG. 1, with the difference that a different preferred embodiment of a discharge lamp 13 is included in diagram 12. Discharge lamp 13 comprises a lamp cap 14, a discharge vessel 15 electrically connected to lamp cap 14 and a parallel circuit of a second condenser 16 and a second inductor 17 electrically connected in series with discharge vessel 15. The presence of the second condenser 16 stimulates the ignition of discharge vessel 15. In addition, condenser 16 has in particular a stabilizing effect on electrical circuit 12.

FIG. 3 shows a discharge lamp 20 provided with an electric component module 21 according to the invention. Discharge lamp 20 is provided with a lamp cap 22, a switching segment 23 connected to lamp cap 22 and an outer bulb 24 connected to switching segment 23. Component module 21 is provided with a socket 25, which socket 25 is adapted for releasable electrical coupling to a plug 26 forming part of switching segment 23. Incorporated in component module 21 is a parallel circuit of a condenser 27 and an inductor 28, which parallel circuit is electrically connected to socket 25. In the outer bulb is arranged a discharge vessel 29 which on one side is electrically connected to lamp cap 22 and on an opposite side is also electrically connected to lamp cap 22 via component module 21. In the case of a malfunction of condenser 27 and/or inductor 28 the component module 21 can be disconnected from switching segment 23 and then replaced by a properly functioning component module. The coupling of component module 21 to switching segment 23 results in a substantially uninterrupted circuit. The configuration shown in FIG. 3 is thus constructed such that the parallel circuit is connected in series with discharge vessel 29. In addition to the component module 21 shown, component modules can also be envisaged which are provided with other electric components and/or a different relative orientation of the components. It will be apparent that a component module can also be positioned between a discharge lamp and an electric circuit, in which case the (existing) discharge lamps and electric circuits do not have to be replaced by new constructions. Positioning of the adaptive component module between the discharge lamp and the circuit is sufficient to create an electric circuit according to the invention.

The invention claimed is:

1. An electric circuit for igniting a discharge lamp, at least one first condenser electrically connected to a voltage source, a series chain, electrically connected in parallel with the first condenser, of at least one ignition and at least one first inductor, the discharge lamp electrically being connected in parallel with the ignition and being provided with a discharge vessel, and a module electrically connected between discharge vessel and the at least one ignition, the module comprising a parallel connection of a second condenser electrically connected in parallel with a second inductor, the parallel connection being electrically connected in series between the discharge vessel and the at least one ignition.

2. The electric circuit as claimed in claim 1, wherein the discharge lamp is formed by a high-pressure discharge lamp.

3. The electric circuit as claimed in claim 1, wherein the discharge vessel is provided with sodium.

4. The electric circuit as claimed in claim 1, wherein the second inductor has an impedance of between 2 Ω and 10 Ω.

5. The electric circuit as claimed in claim 1, wherein the second inductor is incorporated in the discharge lamp.

6. The electric circuit as claimed in claim 1, wherein capacitance of the second condenser lies between 5 nF and 15 nF.

7. The electric circuit of claim 1, wherein the module further comprises:

a plug for releasable coupling of the module to the first condenser; and a socket for releasable coupling of the module to the discharge lamp.

8. A lamp system comprising:

a discharge vessel;

an igniter electrically connected between the discharge vessel and a voltage source;

a first condenser electrically connected in parallel with the voltage source and a series connection of the igniter and a first inductor; and a module electrically connected between discharge vessel and the igniter;

the module including:

a plug releasably coupling the module to the voltage source;

a socket for releasably coupling the module to the discharge vessel, and a parallel connection of a second condenser and a second inductor, the parallel connection being electrically connected in series between the plug and the socket.

* * * * *